US010036537B2

(12) United States Patent
Goris et al.

(10) Patent No.: US 10,036,537 B2
(45) Date of Patent: Jul. 31, 2018

(54) EASY TO INSTALL LUMINAIRE

(71) Applicant: PHILIPS LIGHTING HOLDING B.V., Eindhoven (NL)

(72) Inventors: Herman Jozef Godfried Goris, Olmen (BE); Bea Marie-Louise Jacobs, Mortsel (BE); Thomas Van Den Steen, Moorsel (BE); Tom Willy Greet Wauters, Mortsel (BE); Guido De Mey, Aalst (BE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 169 days.

(21) Appl. No.: 14/780,125

(22) PCT Filed: Mar. 24, 2014

(86) PCT No.: PCT/EP2014/055796

§ 371 (c)(1),
(2) Date: Sep. 25, 2015

(87) PCT Pub. No.: WO2014/154611

PCT Pub. Date: Oct. 2, 2014

(65) Prior Publication Data

US 2016/0040862 A1 Feb. 11, 2016

Related U.S. Application Data

(60) Provisional application No. 61/804,840, filed on Mar. 25, 2013.

(30) Foreign Application Priority Data

Mar. 25, 2013 (EP) ..... 13160778

(51) Int. Cl.
*F21V 21/34* (2006.01)
*F21V 21/02* (2006.01)
(Continued)

(52) U.S. Cl.
CPC ..... *F21V 21/02* (2013.01); *F21V 19/0025* (2013.01); *F21V 21/002* (2013.01); *F21V 21/34* (2013.01); *F21V 23/06* (2013.01)

(58) Field of Classification Search
CPC ..... F21V 21/02; F21V 21/002; F21V 21/34; F21V 19/0025; F21V 19/0085; F21V 23/06
See application file for complete search history.

(56) References Cited

U.S. PATENT DOCUMENTS 2,849,599 A * 8/1958 Kolb ..... F21S 8/04 362/217.05
2009/0175040 A1 7/2009 Green et al.
(Continued)

FOREIGN PATENT DOCUMENTS

DE 701686 C1 1/1941
DE 7431245 U 3/1975
(Continued)

OTHER PUBLICATIONS

JPS47-1981U, 1972.

*Primary Examiner* — Mary Ellen Bowman

(57) ABSTRACT

A luminaire assembly is disclosed comprising a mounting part (2, 7) configured to be attached to a wall or ceiling, a luminaire part (1) configured to be attached to the mounting part (2, 7), and at least one resilient plug (6) and at least one slot configured to engage with each other for attaching the luminaire part (1) to the mounting part (2, 7) without further tooling needs. The luminaire assembly may further comprise plug and play electrical connectors for making the electrical connection between the luminaire part (1) and the mounting part (2, 7). Also a method for mounting a luminaire assembly to a wall or ceiling is disclosed. The method allows an installer to safely mount the luminaire and make connect the
(Continued)

electrical wiring with a minimum of additional tooling or additional hands.

15 Claims, 6 Drawing Sheets

(51) Int. Cl.

| | |
|---|---|
| ***F21V 19/00*** | (2006.01) |
| ***F21V 23/06*** | (2006.01) |
| ***F21V 21/002*** | (2006.01) |

(56) References Cited

U.S. PATENT DOCUMENTS

| | | | | |
|---|---|---|---|---|
| 2011/0226919 | A1 | 9/2011 | Fryzek et al. | |
| 2012/0180834 | A1* | 7/2012 | Pineda | A45B 25/02 135/25.1 |
| 2014/0104857 | A1* | 4/2014 | Spintge | F21K 9/00 362/368 |

FOREIGN PATENT DOCUMENTS

| | | | | |
|---|---|---|---|---|
| DE | 19604222 | A1 | | 8/1997 |
| DE | 102010038251 | A1 | | 4/2012 |
| GB | 2120024 | A | | 11/1983 |
| GB | 2375163 | A | | 6/2002 |
| JP | 05190011 | A | * | 7/1993 |
| JP | H05190012 | A | | 7/1993 |
| JP | H06162816 | A | | 6/1994 |
| JP | H09259629 | A | | 10/1997 |
| JP | 2001297618 | A | | 10/2001 |
| JP | 2006024513 | A | | 1/2006 |
| JP | 2012015075 | A | | 1/2012 |
| JP | 2012204140 | A | | 10/2012 |
| JP | 2013051053 | A | | 3/2013 |
| KR | 20120110407 | A | | 10/2012 |

* cited by examiner

EASY TO INSTALL LUMINAIRE

CROSS-REFERENCE TO PRIOR APPLICATIONS

This application is the U.S. National Phase application under 35 U.S.C. § 371 of International Application No. PCT/EP2014/055796, filed on Mar. 24, 2014, which claims the benefit of U.S. Provisional Patent Application No. 61/804,840, filed on Mar. 25, 2013 and European Patent Application No. 13160778.0, filed on Mar. 25, 2013. These applications are hereby incorporated by reference herein.

FIELD OF THE INVENTION

The invention relates to the field of lighting, and more specifically to a luminaire.

BACKGROUND OF THE INVENTION

Prior art mounting methods of luminaries typically use a bracket that is to be mounted on the ceiling or wall and the luminaire that is in turn to be attached to the bracket. Attaching the luminaire to the bracket is often realized by means of screwing connections. This is sometimes very cumbersome and difficult for installers to perform because of the need for additional tools e.g. screws and a screw driver to connect the luminaire to the bracket; furthermore the electrical connection of the luminaire to the mains power must already be made before the luminaire is mounted to the bracket.

Furthermore, the installer needs to make the electrical connection, take the screws and the screw driver and screw the parts together while holding the luminary in his hands.

SUMMARY OF THE INVENTION

The invention seeks to address some of the problems listed above.

A luminaire assembly is disclosed that comprises a mounting part that is configured to be attached to a wall or a ceiling, a luminaire part that attaches to the mounting part, at least one resilient plug and at least one slot.

The resilient plug is configured to engage with the corresponding slot, the slot and the plug are arranged with respect to the mounting part and the luminaire part so as to enable the attachment of the luminaire part to the mounting part.

Preferably the mounting part and the luminaire part are releasably attached using at least one resilient fixing. In a preferred embodiment, the resilient fixing comprises a spring-loaded plug or spring-loaded pin designed to cooperate with a corresponding hole. The resilient fixing enables the installer to position the luminaire part relative to the already attached mounting part and to connect the two parts together without any tooling. In a further preferred embodiment, the corresponding hole is a through-hole which allows the installer to detach the luminaire part from the mounting part by pushing the plug or pin against the loading force of the spring of the spring-loaded plug respectively spring-loaded pin. This action releases the fixing and allows detaching the luminaire without specific tooling. In another embodiment, the luminaire part and the mounting part may be connected via two resilient fixings as described above, for example one at opposite ends of the assembly. Alternatively, the luminaire part and the mounting part may be connected via one resilient fixing on one and of the assembly and a non-resilient fixing on the other end of the assembly; the resilient fixing may comprise a spring-loaded plug with corresponding hole and the non-resilient fixing may comprise a protrusion with a corresponding recess that cooperate together to make a mounting connection.

Preferably the mounting part has an electrical sub-assembly attached. This sub-assembly can include a universal termination block and a more uniform electrical interface such as a Mate N Lok® connector. The universal termination block is adapted to receive the electrical wires available in the wall or ceiling. The advantage of the universal terminal block is that is can receive wires of various types and thicknesses, dependent on the circumstance of the case. The majority of universal terminal blocks are operated with screwing connections. The electrical interface connector on the other hand is adapted to make the electrical connection from the mounting part to the luminaire part. It is not designed to be universal but preferably is designed to be operated without specific tooling. This allows to electrically connect the luminaire part to the mounting part without the need for specific tooling, as in most case the installer holds the luminaire part while making the electrical connection between the luminaire part and the mounting part. In this embodiment, the mounting part further comprises electrical connections between the universal terminal block and the electrical interface connector such that electrical power can be forwarded from the wires in the wall or ceiling to the luminaire part. Before the electrical connections are made, the mounting part can be mechanically fixed in the desired position on the wall or ceiling, in a known way e.g. using screws, and thereafter the electrical wiring can be inserted into the universal termination block. This leads to a much safer installation as the installer has both hands free to safely connect the wiring to the already attached mounting part rather than having to hold the luminaire part, the mounting part and the wiring simultaneously as often is the case with current luminaires.

Preferably the mounting part further comprises a rail. This rail may be provided with an electrical sub-assembly comprising a universal terminal block and a uniform interface connector as described above. The electrical sub-assembly may be arranged upon the rail so that the electrical sub-assembly can slide along the rail. This allows the installer to fix the mounting part in a desired position on the wall or ceiling, without taking into consideration restrictions as to the position of the electrical terminal block relative to the electrical wires as the electrical terminal block may be repositioned along the rail. That is, the mounting part may be mounted in a position as desired by the installer or end user and the electrical sub-assembly may be slid to a position close enough to the electrical wiring. This removes the need for the installer to extend the wiring between the electrical sub-assembly and the existing wiring, which otherwise may be the case.

Preferably the electrical sub-assembly comprises a single electrical connector that fulfills the role of the two separate electrical connectors discussed above; the connector is universal on one side for the installer to insert the existing wiring and the other side is a more standard plug for connection to the more standard socket that is connected to the wiring in connection with the driver.

A method of mounting a luminaire assembly, comprising the steps of:

mounting a mounting part of the luminaire assembly to a wall or ceiling, and releasably attaching a luminaire part of the luminaire assembly to the mounting part by means of a resilient plug and corresponding hole, wherein the step of releasably attaching the luminaire part to the mounting part further comprises positioning the resilient plug in the proximity of the corresponding hole, pushing the resilient plug against a bias, engaging the resilient plug with the corresponding hole and releasing the plug.

An installation guide may be provided, this guide comprising instructions for executing the method of mounting the luminaire, this guide may take the form of a paper document or it may be stored on a recording medium. It may be an App to be viewed on a mobile device whilst carrying out the installation. It may be a video or a link to a website providing an interactive installation guide.

These and other aspects of the invention will be apparent from the drawings below and will be discussed in more detail hereafter.

DETAILED DESCRIPTION OF EMBODIMENTS

Figure 1:
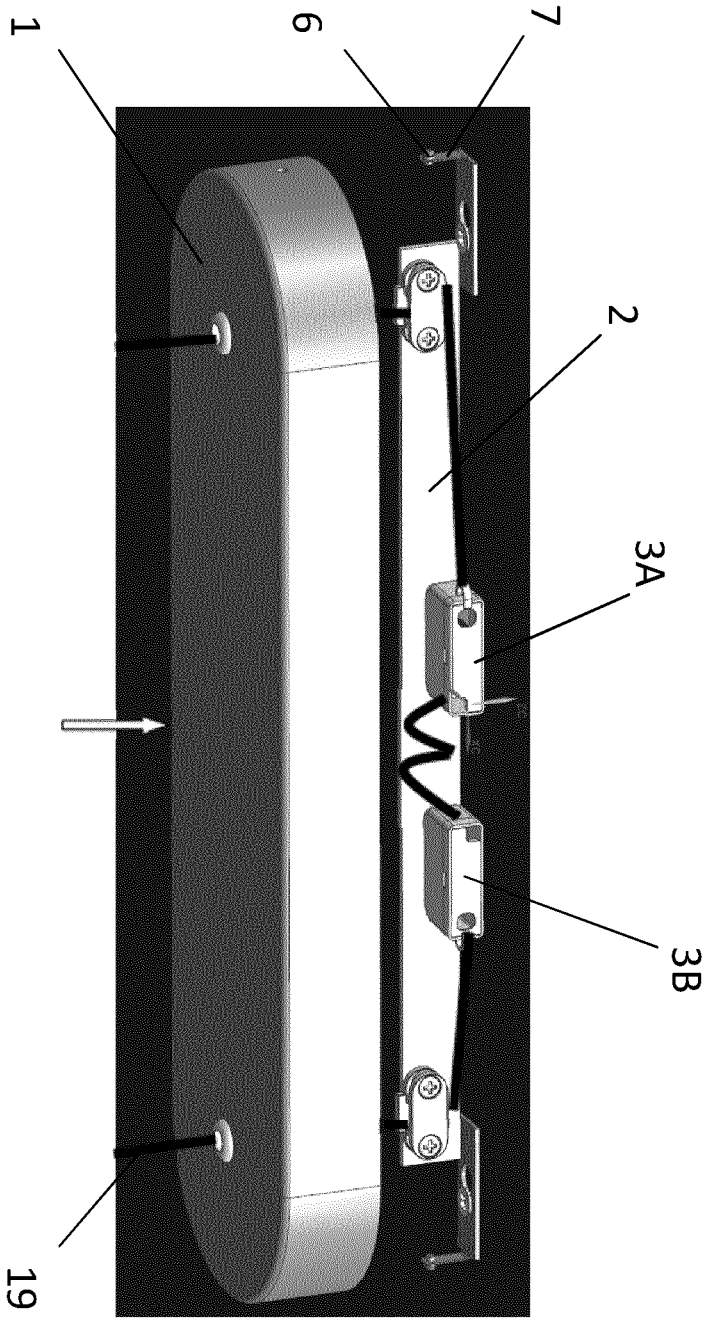
FIG. 1 shows a luminaire part, mounting part and electrical sub-assembly connected together in accordance with an embodiment of the invention.

FIG. 1 shows a 3D elevated view of an embodiment of a luminaire assembly. The mounting part comprises at least one resilient plug. In the drawing, two resilient plugs are shown: one on the left hand side of the drawing and another on the right hand side to of the drawing. Each of the resilient plugs comprise a housing (not shown in this particular embodiment) a plunger 6 and a biasing means 7. The mounting part further comprises a rail 2 and electrical sub assembly 3A, 3B shown in a certain position on the rail 2. The universal termination block 3A can be on one side connected to the existing wiring in the wall or ceiling and on the other side connected to an electrical interface connector 3B. The connection between the universal terminal block 3A and the electrical interface connector 3B is made internally within the mounting part. In FIG. 1, the electrical interface connector is depicted as a MATE N LOK® connector and show the male and female connector in a connected position. In this embodiment, the universal terminal block 3A is connected to the male part of the electrical interface connector 3B. The female part of the electrical interface connector 3B is comprised in the luminaire part of the luminaire assembly and connects internally within the luminaire part to a driver 5 of the luminaire. With the electrical connection being made, the luminaire part 1 (represented in FIG. 1 as the cover) is maneuvered relative the mounting part (represented in FIG. 1 as the rail) so that the plungers engage with the corresponding slots in the luminaire part thus securing both parts together. The electrical wiring 19 then exits the luminaire to provide power to the lighting means.

The resilient plug is generally located at the end of the rail 2 although alternative embodiments would allow the resilient plug to slide along the rail thus allowing the mounting device to provide a resilient fixing at a suitable location along the luminaire parts' length.

In a further embodiment wherein a resilient plug is located at a first end of the rail 2 and a non-resilient plug is located at a second end of the rail, the installer would first move the luminaire part to engage the non-resilient plug (e.g. a protrusion on the mounting part) with its corresponding slot (e.g. a recess in the luminaire part) at the second end the rail or luminaire assembly, then move the luminaire part to engage the resilient plug with its corresponding slot at the first end of the rail or luminaire assembly. This provides a cost saving advantage as it would simplify the manufacturing process and increase mechanical reliability due to there being no moving parts in the non-resilient plug.

The non-resilient plug and corresponding hole can be manufactured in numerous ways, the two most suitable methods envisioned would be either molded parts (either injection molded or cast) or machined parts; preferably due to the suitability of the process for high-volume and low cost parts, injection molded parts would be preferred.

The housing of the resilient plug 4 can be manufactured in numerous ways; an embodiment would be to manufacture the housing in 2 or more parts. The preferred orientation between the mating faces of the parts would be co-axial with the centerline of the bore. The two or more parts would have a portion of the stepped bore formed within. The plunger would have a raised shoulder at one end and would be placed into one part along with a spring. The other part(s) would then be brought into alignment thus constraining the plunger.

A further embodiment would be to manufacture the housing in 2 parts that are hinged together. A portion of the stepped bore would be formed in each part and when a stepped plunger and spring are inserted into one part and the other is hinged into position the plunger would be constrained.

Figure 2:
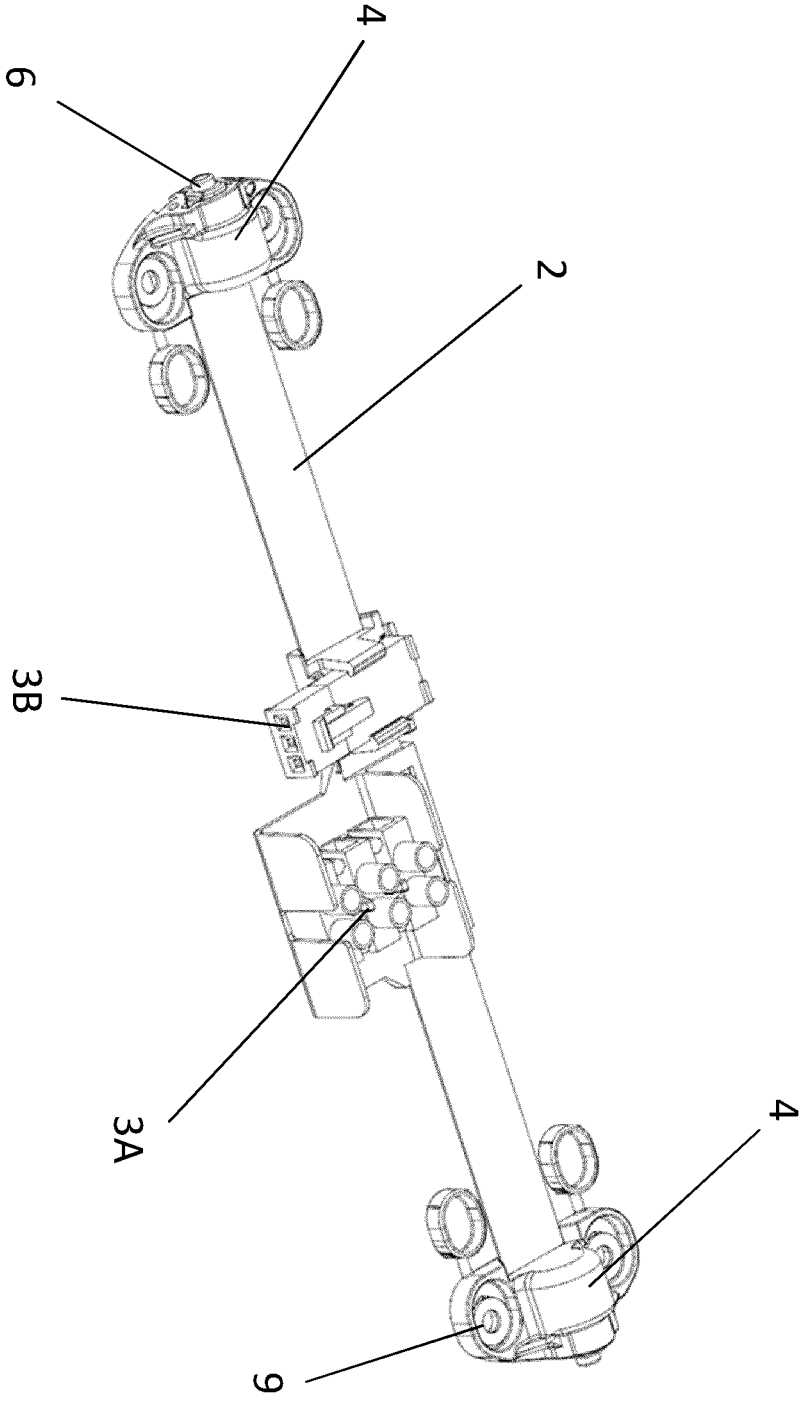
FIG. 2 shows an embodiment of a mounting part and electrical sub-assembly.

FIG. 2 shows an embodiment of the mounting part. The mounting part comprises a rail 2 upon which the electrical sub-assembly 3A, 3B is located; preferably this sub-assembly can slide along the rail. Resilient plugs are located at both ends of the rail 2. They comprise a housing 4 fitted with biasing means (not shown) and a plunger 6. The mounting part is mounted in the desired position against the wall or ceiling using the plurality of holes 9 in the housings 4.

The electrical sub-assembly can preferably slide along the rail; this allows the installer to easily connect the electrical wiring if the luminaire assembly is to be mounted in a position that is not central to the wiring that pre-exists at the desired location in the wall or ceiling. This offers the installer several advantages. Firstly the installer can position the luminaire assembly in a desired location that is less dictated by the existing wiring in the wall or ceiling than is currently the case. Secondly as there is no requirement for the installer to extend the wiring between the pre-existing wiring and the universal termination block 3A there is no additional cost implications for additional wire or connectors. Thirdly there is no necessity for the installer to have to stop the installation whilst additional wiring and connectors are procured. These advantages lead to both cost and time savings for the installer.

Figure 3:
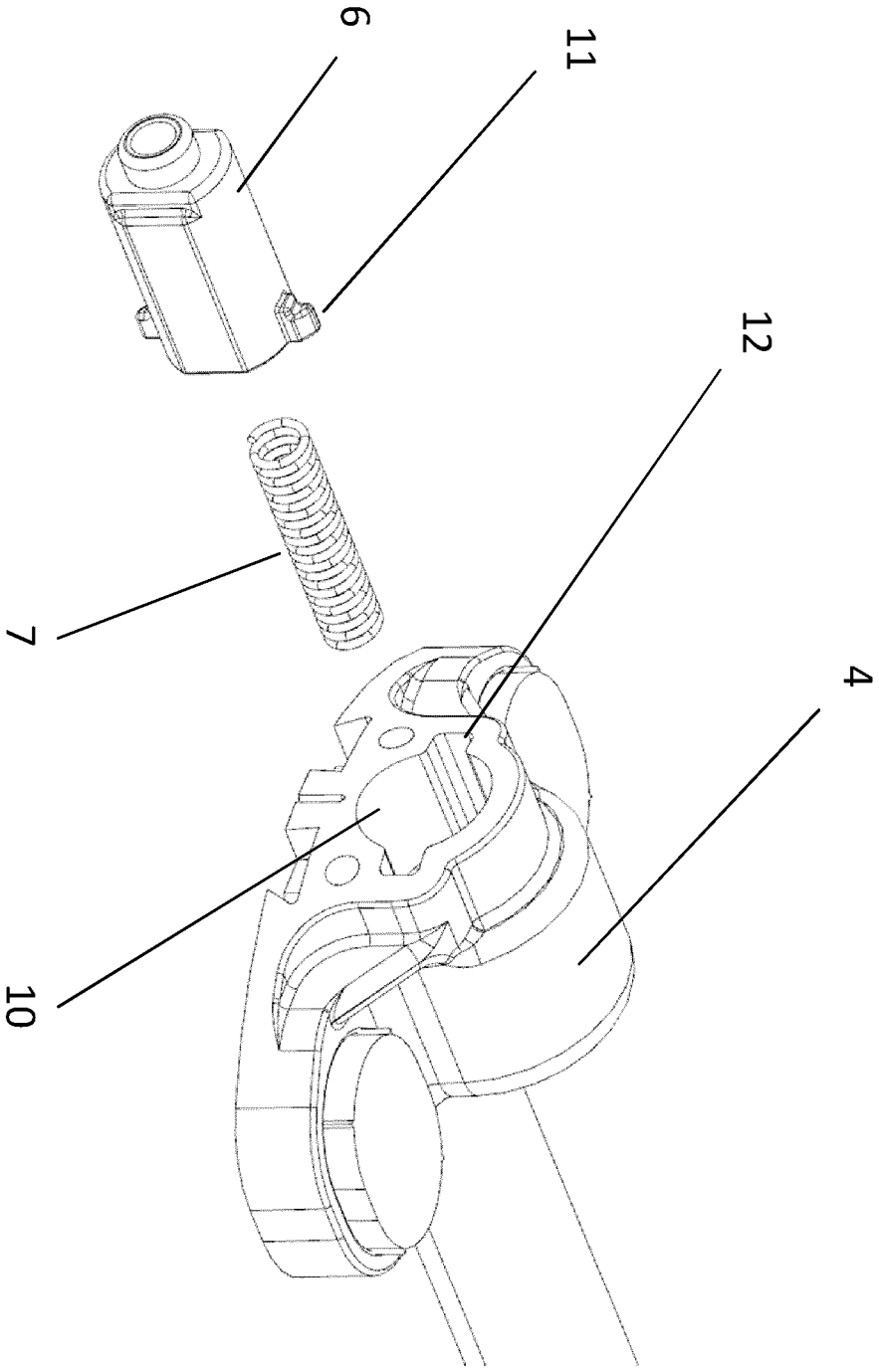
FIG. 3 shows a more detailed view of an embodiment of a resilient plug.

FIG. 3 shows an embodiment of the resilient plug, comprising a housing 4 which has a bore 10. The biasing means 7 sits inside the bore and is configured to act upon a closed end of the bore and a plunger 6. The plunger has two protrusions 11 that fit inside two slots 12 in the housing 6, once the plunger 6 is inserted it is rotated so that the protrusions 11 no longer align with the slots (12) but are constrained within an enlarged bore.

A further embodiment of the plunger could have one or more circumferentially arranged slots. These slots could extend partially along the plunger's length and would terminate before reaching the end of the plunger. The housing 4 could have corresponding pins that projected into the bore and would constrain the plunger and prevent it being biased out of the bore.

Multiple alternative embodiments of a resilient plug can readily be envisioned by the skilled person.

Figure 4:
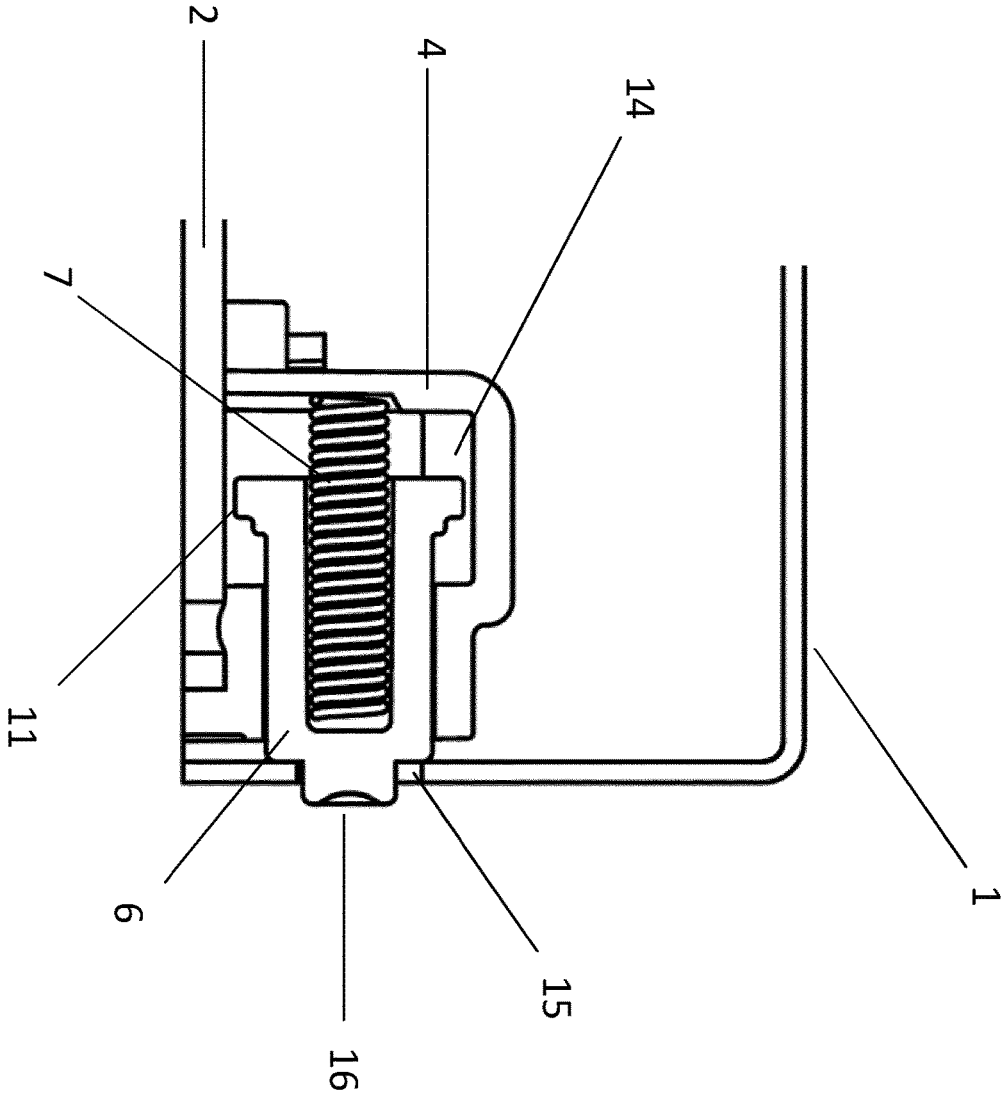
FIG. 4 shows a sectional view of a resilient plug attached to a mounting part and engaging with a slot in a luminaire part in accordance with an embodiment of the invention.

FIG. 4 shows a preferred embodiment of the resilient plug in a cross-sectional view and drawn in the context of the corresponding hole in a luminaire part. The housing 4 is located upon the rail 2, the housing 4 has a stepped bore 14. A first portion of the bore is configured to locate the plunger 6 while a second portion of the bore is enlarged and constrains the protrusions 11 of the plunger 6. There is a biasing means 7 fitted within the plunger 6 and this biasing means 7 acts upon a closed face 18 of the housing 4 and the plunger 6. In the configuration shown in FIG. 4, the plunger 6 is able to move in a longitudinal direction but the protrusions 11 and the enlarged portion of the stepped bore 14 acts to constrain the movement of the plunger 6 by preventing the biasing means 7 from displacing the plunger 6 from the stepped bore 14 range. The plunger 6 may have a nose section 16 that is intended to cooperate with a slot 15 in the luminaire part 1 by positioning the nose section 16 through the slot 15 and thus secure the luminaire part 1 to the mounting part.

Figure 5:
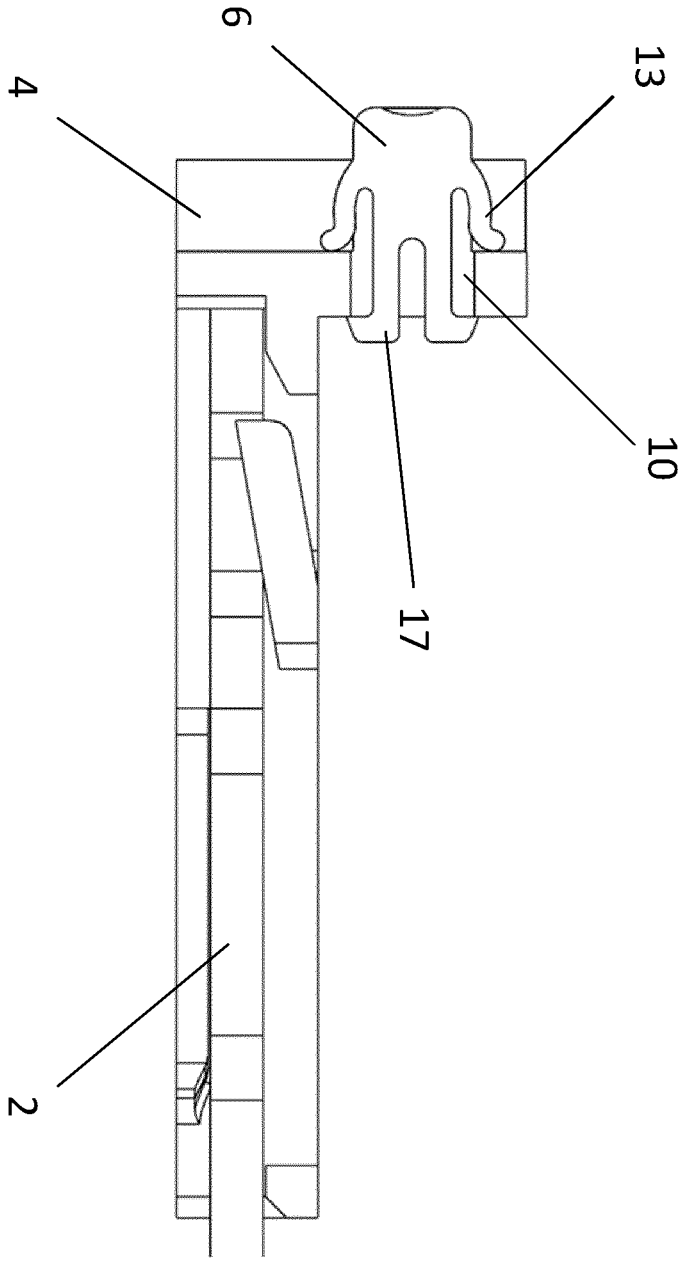
FIG. 5 shows a sectional view of a resilient plug attached to a mounting part and engaging with a slot in a luminaire part in accordance with a further embodiment of the invention.

FIG. 5 shows a further embodiment of the resilient plug in a cross-sectional view. A housing 4 is located on a rail 2, the housing comprises a bore 10 formed throughout. A plunger 6 is inserted into the bore. The plunger is preferably manufactured from a material that has inherent elasticity (such as Polyoxymethylene (POM), or Nylon). There is no external biasing means fitted in this embodiment. The biasing action is provided by fingers 13 of the plunger 6 acting upon the housing 4. The surface upon which these fingers act can be realized in many ways, for example it could be a slot cut into the housing or a stepped bore. To prevent the plunger from being biased out of the housing by the fingers, at least two further fingers 17 are provided, these further fingers preferably have a return formed at the end. When the plunger is inserted in the bore these fingers 17 splay inwards and when the returns have passed the end face of the bore they return to their original position thus locking the plunger 6 in the bore 10.

When actuated, the plunger is forced back which causes the fingers 13 to splay outwardly and allow the plunger nose to recess i.e. move inwards. The inwards position of the plunger nose allows disengaging the plunger nose from the corresponding slot in the luminaire part thus allowing the luminaire part to be detached from the mounting part. When the force is removed from the plunger the fingers 13 return to their original position and the nose of the plunger again protrudes.

The advantages of this embodiment are simplicity of assembly and reduction of the number of parts used with associated cost benefits.

Figure 6:
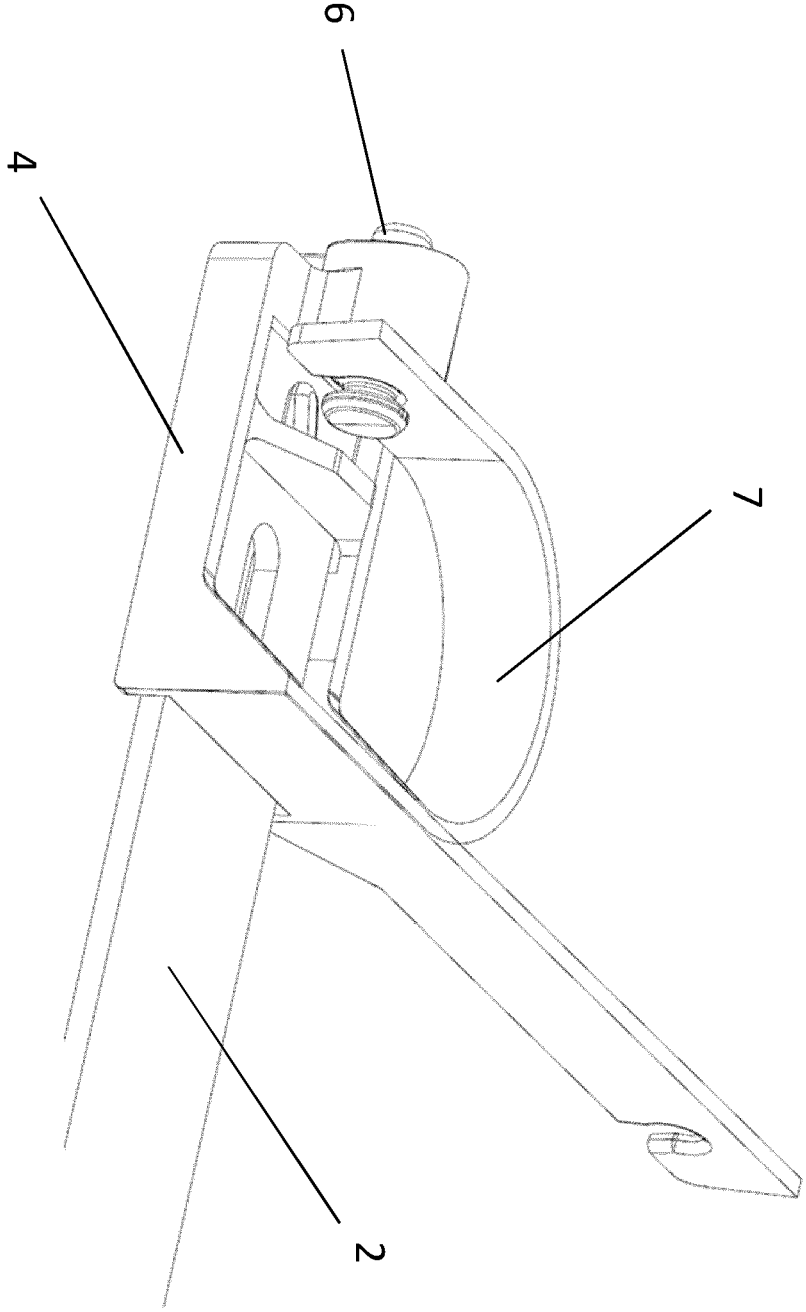
FIG. 6 shows a resilient plug attached to a mounting part in accordance with an embodiment of the invention.

FIG. 6 shows a further embodiment of the resilient plug, wherein the resilient plug is again arranged in the mounting part. A housing 4 is located on a rail 2. The housing is provided with a through-bore, that is to say a bore with both ends open. Located within this bore is a plunger 6 which has a nose section on one end for engaging with a corresponding slot in a luminaire part and a slit section on the other end that is configured to receive and connect to a curved biasing means 7. This curved biasing means is preferably manufactured from a material that has an inherent elasticity such as a plastic. This curved biasing means can be looked upon as a type of leaf spring and the terms curved biasing means and leaf spring may be used interchangeably in the further description.

The leaf spring is attached to the plunger 6 at one end and to the housing 4 at the other one. Preferably the size of the leaf spring at the end that connects to the plunger is larger in area than the diameter of the bore in which the plunger is located. This means that in operation the spring itself prevents the plunger from being biased out of the housing 4. Obviously this spring could be manufactured from numerous materials; for example, metal and still carry out the same function.

In use the biasing means 7 acts upon the plunger 6 and ensures that the nose section of the plunger protrudes sufficiently to be able to engage with a slot within the luminaire part. When the luminaire part is to be removed the plunger is forced into the housing 4 thus compressing the biasing means 7 and the nose of the plunger disengages with the corresponding slot within the luminaire part allowing it to be detached.

The advantages of this embodiment are light-weight, simplicity of manufacture and assembly and low cost.

A method for mounting a luminaire assembly, comprising the steps of;

mounting a mounting part of the luminaire assembly to a wall or ceiling, and releasably attaching a luminaire part of the luminaire assembly to the mounting part by means of a resilient plug and corresponding hole, Wherein the step of releasably attaching the luminaire part to the mounting part further comprises positioning the resilient plug in the proximity of the corresponding hole, pushing the resilient plug against a bias, engaging the resilient plug with the corresponding hole and releasing the plug.

Wherein the step of mounting a mounting part of a luminaire assembly further comprises using known means to attach the mounting part in the desired location. These known means may include screws, for example, fitted through the mounting holes in the resilient plug housing, or fitted directly through the rail. If fitted through the rail it is preferable that the screws are countersunk, this may provide a flush surface upon which the electrical sub assembly may slide; or hooks that attach the mounting part in the desired location.

Preferably the step of releasably attaching the luminaire part to the mounting part further comprises connecting the electrical wiring; this step preferably further comprises connecting the existing wiring to the universal termination block.

Preferably the step of releasably attaching the luminaire part to the mounting part further comprises joining the two parts of the standard electrical connector, one part of which is connected to the driver within the luminaire part and the other part has wiring that connects to the universal termination block.

An installation guide may be provided to ease the installation. This guide may be in the form of a paper document, it may be stored on a recording medium, be provided as an App to a mobile device, supplied as a video or a website address may be provided that allows the installer to log onto a website for an interactive fitting guide.

While the invention has been illustrated and described in detail in the drawings and foregoing description, such illustration and description are to be considered illustrative or exemplary and not restrictive; the invention is not limited to the disclosed embodiments.

It can be seen by the skilled person that the luminaire part may comprise the resilient plug and the mounting part may comprise the corresponding hole. This gives the advantage that the mounting part is then a very simple and therefore cheap to manufacture part.

The invention claimed is:

1. A luminaire assembly comprising:

a mounting part attachable to a wall or ceiling, a luminaire part attachable to the mounting part, at least one resilient plug on the mounting part, and at least one corresponding slot on the luminaire part, wherein the at least one resilient plug is compressible into the mounting part along a longitudinal direction of the mounting part and configured to engage with the at least one corresponding slot, thereby attaching the luminaire part to the mounting part without additional tooling.

2. The luminaire assembly of claim 1, wherein the at least one resilient plug comprises a moveable plunger.

3. The luminaire assembly of claim 1, wherein the at least one corresponding slot is a through-hole through which the resilient plug is accessible for detaching the luminaire part from the mounting part.

4. The luminaire assembly according to claim 1 wherein the mounting part comprises at least one resilient plug located in a housing, said housing comprising a bore for receiving said resilient plug and a biasing means for biasing said resilient plug towards one end of said bore.

5. The luminaire assembly of claim 4 wherein the biasing means is a helical spring or a leaf spring.

6. The luminaire assembly of claim 4 wherein the resilient plug has at least one protrusion and the housing has at least one slot; the at least one protrusion configured to engage with the at least one slot; said at least one slot allowing the resilient plug to be inserted and rotated; once rotated the resilient plug cannot be biased out of the housing.

7. The luminaire assembly according to claim 1, further comprising a first electrical connector and a second electrical connector, the first and second electrical connectors for engaging with each other and electrically connecting the luminaire to the mains power, wherein the mounting part comprises one of the first and second electrical connectors and the luminaire part comprises the other of the first and second electrical connectors.

8. The luminaire assembly according to claim 1, wherein the mounting part further comprises a rail and wherein one of the at least one resilient plug or at least one corresponding slot is arranged on the rail.

9. The luminaire assembly according to claim 8, wherein the at least one resilient plug or at least one corresponding slot is located at a distal end of the rail.

10. The luminaire assembly of claim 8, wherein the at least one resilient plug or at least one corresponding slot is slideably arranged along the rail for attaching the luminaire part to the mounting part at any suitable location along the rail.

11. The luminaire assembly according to claim 8 wherein at least one resilient plug is arranged on the rail and further at least one non-resilient plug is arranged on the rail.

12. The luminaire assembly according to claim 7, wherein the mounting part further comprises a rail and wherein one of the first electrical connector or second electrical connector is arranged on the rail.

13. The luminaire assembly according to claim 12, wherein the one of the first electrical connector or second electrical connector is slideably arranged along the rail for electrically connecting the luminaire to the mains power at any suitable location along the rail.

14. The luminaire assembly according to claim 1, wherein the mounting part comprises the at least one resilient plug and wherein the luminaire part comprises the at least one corresponding slot.

15. A method of mounting a luminaire assembly, comprising the steps of:

mounting a mounting part of the luminaire assembly to a wall or ceiling, the mounting part comprising a resilient plug that is compressible along a longitudinal direction of the mounting part, and releasably attaching a luminaire part of the luminaire assembly to the mounting part by means of the resilient plug and a corresponding hole without additional tooling, wherein the step of releasably attaching the luminaire part to the mounting part further comprises positioning the resilient plug in the proximity of the corresponding hole, pushing the resilient plug into the mounting part against a bias, engaging the resilient plug with the corresponding hole, and releasing the resilient plug.

* * * * *